United States Patent [19]

Lemmer

[11] 4,013,570

[45] Mar. 22, 1977

[54] GRAPHITE AND COPPER IN HOT FORGING LIQUID LUBRICANT

[75] Inventor: Harold G. Lemmer, New Baltimore, Mich.

[73] Assignee: General Motors Corporation, Detroit, Mich.

[22] Filed: Apr. 7, 1975

[21] Appl. No.: 565,873

[52] U.S. Cl. ..... 252/30; 72/42; 252/49.5

[51] Int. Cl.[2] ..... C10M 1/10; C10M 3/02; C10M 5/02; C10M 7/04

[58] Field of Search ..... 252/30, 49.5; 72/42

[56] References Cited

UNITED STATES PATENTS

| | | | |
|---|---|---|---|
| 2,326,000 | 8/1943 | Teeple | 252/30 |
| 2,416,480 | 2/1947 | Henry et al. | 252/30 |
| 3,804,761 | 4/1974 | Milz et al. | 252/30 |
| 3,931,020 | 1/1976 | Burgess et al. | 252/30 |

OTHER PUBLICATIONS

"Copper–Graphite Materials with Additives of Graphite Granules Plated with Copper" by D. S. Yas et al. in Porosh. Met. (USSR), No. 5, pp. 70–75, S15150034, May, 1971.

*Primary Examiner*—Delbert E. Gantz
*Assistant Examiner*—I. Vaughn
*Attorney, Agent, or Firm*—Robert J. Wallace

[57] ABSTRACT

An improved colloidal graphite hot forming lubricant and hot forming process for high density ferrous powdered metal articles using this lubricant. Extremely fine powdered copper is included in an otherwise conventional colloidal graphite hot forming lubricant. High quality, including high density, ferrous metal articles are produced by coating a ferrous powdered metal preform with this lubricant, presintering the coated preform at a higher temperature of 2100° – 2500° F. for a short time by induction heating, allowing the presintered preform to cool to a desired hot forming temperature below 2000° F., and then hot forming the preform in the usual manner. Lubricant-preform interaction at the higher temperature is precluded, making long presintering times and special presintering equipment necessary.

3 Claims, No Drawings

GRAPHITE AND COPPER IN HOT FORGING LIQUID LUBRICANT

BACKGROUND OF THE INVENTION

This invention relates to an improved colloidal graphite hot forming lubricant and to a method of hot forming powdered ferrous preforms using this lubricant.

In commercial production hot forming operations, a press is used to mechanically work a hot metal preform into predetermined shape. A lubricant is applied to the metal preform as well as to the die components in the press. Ferrous powdered metal articles are hot formed at temperatures of about 1200° –2000° F. Colloidal graphite dispersions are effective lubricants at these temperatures, and are typically used as hot forming lubricants.

There is a high interest in replacing wrought metal parts with parts derived from powdered metal preforms. Properties such as ductility and impact strength of hot formed articles made from powdered metal preforms benefit greatly from a sintering of the preform (commonly referred to as presintering by those skilled in the art) prior to the hot forming operation. In general, the higher the presintering temperature and the longer the soaking time at this temperature, the greater the benefit. This preliminary heat treatment, presinter, also produces carbon solution and oxide reduction, the latter being of particular benefit to impact strength.

A normal and accepted presintering procedure for producing maximum properties in ferrous powdered metal articles involves heating a ferrous powdered metal preform for about one hour at about 2000° F. This actually requires a total furnace time of several hours. After presintering, the preform is cooled to about 400° F. for lubricant application. A colloidal graphite lubricant is then applied, for example by dipping the preform into it. Then the preform is reheated to the desired hot forming temperature and hot formed in the usual manner.

I have recognized that the same maximum property improvement produced by the above-described furnace treatment can be achieved much more quickly, and more economically, and with less total energy. It is achieved by a short induction heating at higher temperatures, as for example 2350° F. for 60 seconds. This recognition is particularly significant because induction heaters are frequently used to reheat presintered powdered metal preforms to hot forming temperatures. These same induction heaters could also be used to presinter lubricant-coated powdered metal preforms. If so, only one heating operation would be required for both presintering and hot forming. This obviously saves energy. Moreover, no separate presintering equipment, preform handling, furnace floor space, and the like would be required. Accordingly, presintering by induction heating is particularly attractive from a commercial production standpoint.

In order to obtain highest quality products, the ferrous powdered metal preforms must be presintered at a temperature above about 2100° F. Moreover, the hot forming lubricant must be applied before heating, to avoid an intermediate cool down for lubricant application between presintering and hot forming. Unfortunately, above about 2050° F., a reaction between the colloidal graphite lubricant and the ferrous powdered metal occurs. This reaction produces surface melting on the ferrous powdered metal preform. Not only does this degrade properties in the resultant article, but it also makes optical monitoring of the preform temperature impossible. When using induction heating, preform temperature is most effectively monitored with an optical pyrometer. Even incipient surface melting changes the optical emissivity of the preform, and the degree of change is erratic. Temperature monitoring of induction heated ferrous powdered metal preform above temperatures of about 2050° F. therefore becomes unreliable. This effectively limits the use of induction heating to lower temperatures, where long heating times are required for maximum presintering effects. This makes induction heating for presintering commerically unattractive, particularly when highest quality articles are desired.

On the other hand, I have found an additive for commercial colloidal graphite lubricants that inhibits the lubricant ferrous powdered metal preform interaction that ordinarily occurs above about 2050° F. This additive permits one to precoat a preform with lubricant and then presinter above 2100° F. without any noticeable interaction. The lubricant coated preform can now be presintered above 2100° F. during the same heating step, and using the same induction heater, that is now used only to warm a presintered preform up to hot forming temperature after lubricant application. Preforms for high quality ferrous powdered metal articles no longer have to be presintered in a separate and distinct heating operation, cooled, coated with lubricant, and then reheated again to hot forming temperature. I can now combine the two separate heating steps into one operation, to permit sizeable savings in capital investment, time, labor and a variety of ancillary expenses.

OBJECTS AND SUMMARY OF THE INVENTION

It is, therefore, an object of this invention to provide an improved colloidal graphite hot forming lubricant.

Another object of this invention is to provide an improved method of hot forming highest quality ferrous powdered metal articles using colloidal graphite lubricants.

These and other objects of the invention are attained with a colloidal graphite hot forming lubricant that is improved by the addition of about 2% to 4% by weight of copper powder. The copper powder has an average particle size less than about 50 microns. In making a highest quality ferrous powdered metal article, my improved lubricant is applied to a ferrous powdered metal preform before it is presintered. The preform is then induction heated to a temperature of about 2100° –2500° F. for a minute or so, allowed to cool below about 200° F., and then hot formed in the usual manner. A separate preliminary sintering operation is not required to obtain highest quality articles. Presintering can now by done during the same induction heating operation normally used only to warm presintered preforms to hot forming temperatures. The temperature of the preform during induction heating can now be precisely optically monitored above about 2050° F., because there is no significant lubricant-ferrous powdered metal interaction.

DESCRIPTION OF THE PREFERRED EMBODIMENT

Colloidal graphite-type forging lubricants are substantially suspensions of colloidal size graphite particles in a liquid carrier. The colloidal graphite particles have an average particle size less than about 1 micron. Graphite particles larger than about 1 – 2 microns ordinarily cannot be permanently suspended in most liquid carriers, even with the use of special dispersing agents. It is recognized that semicolloidal graphite suspensions are also commercially available. In these latter suspensions, the particles are not as permanently suspended. The colloidal particles are either not adequately deflocculated or they contain a proportion, usually small, of somewhat larger size particles. However, these latter suspensions can also be used as forging lubricants and are considered to be colloidal for purposes of this invention.

A variety of liquid carriers can be used for the colloidal graphite suspensions, including water, oil, alcohols, and synthetic lubricants. The suspension is normally sold in a concentrated form, approximately 10% – 30% by weight colloidal graphite particles, and diluted for use. The degree of dilution used varies according to the particular concentrate one starts with, and the preference of the user for the particular article being made. Economy is another consideration in determining the dilution factor used. A typical dilution is one part of the concentrate to about 10 – 20 parts of a diluent, especially for the concentrates having 20% – 30% by weight colloidal graphite. However, concentrates having 30% by weight solids may even be diluted up to about 1/100 of their original strength. The diluent should be at least miscible with the carrier liquid of the concentrate. The most suitable diluent would be a liquid which is the same as used for the liquid carrier in the concentrate.

In my invention I include at least 2% by weight of a fine copper powder in the diluted colloidal graphite lubricant, that is, in the lubricant as it is actually used in hot forming. This proportion of powder can be added to the diluted lubricant, or a correspondingly higher proportion included in the lubricant concentrate, as one chooses.

It appears that the copper powder provides an isolating barrier on the powdered metal particles. It may be that the copper powder is so fine and so uniformly dispersed that when it melts it forms a very thin but substantially continuous coating on the outer surface of the preform that is in contact with the lubricant. This inhibits the lubricant-iron interaction previously referred to on the preform. Also, an increase in lubricity may be an added benefit. On the other hand, the amount of copper present is insufficient to deleteriously alter the predetermined metallurgical properties of the hot formed article, even at its surface. The resultant article appears as if no copper were present in the lubricant and no subsequent treatment is necessary because the copper powder was used in the lubricant. A powder of pure copper is preferred. However, the term copper powder is also intended to include any copper alloy having more than 50% copper and having a melting point temperature less than about 2000° F.

At least about 2% by weight of copper powder having a particle size of the order of about 15 microns seems necessary in the diluted lubricant, the lubricant as used, to insure that the lubricant-iron interaction on the preform is suppressed. If the copper powder is included in the concentrated lubricant, the minimum weight percent copper powder to be included will vary, depending on the extent to which the concentrated lubricant is to be diluted. For example, if one part of the colloidal graphite concentrated lubricant contains 30% by weight solids and lubricant is to be diluted with thirteen parts of a diluent, at least about 21% by weight copper powder should be included. An equivalent dilution of a colloidal graphite concentrated lubricant containing only 10% by weight solids, on the other hand, would require only about 8% by weight copper powder. This corresponds to a ratio of at least about 0.7:1 by weight of copper powder to graphite, respectively. This provides a ratio by weight of Cu powder to graphite in the concentrate of at least about 0.7. Proportions of copper powder in excess of about 2% in the diluted lubricant can be used but have not been found to provide any increased benefits. A copper powder concentration greater than about 4% by weight in the diluted lubricant is to be avoided. It may adversely affect the metallurgical properties of the resultant article and, of course, increases lubricant cost. This latter concentration corresponds to a ratio of about 2:1 by weight of copper powder to graphite in a 13:1 dilution of a colloidal graphite concentrated lubricant with 30% by weight solids. In dilutions of this latter concentrate up to about 100:1, 4% by weight powdered copper provides a ratio of about 13:1 by weight of powdered copper to graphite, respectively.

It is important that the particle size of the copper powder used in this invention by extremely fine. If the particle sizes are too large, maintaining a uniform suspension is more difficult, and larger, undesirable proportions may be required to obtain a continuous isolating coating. In general, I prefer copper powder particle sizes as close to the size of the colloidal graphite particles as possible. However, copper powder particle sizes of the order of 15 microns have proved to be highly effective. It is expected that particle sizes up to about 50 microns can be used. Also, I believe that the minimum proportion of copper powder that is necessary to obtain an isolating coating may be a function of the particle size of the copper powder. Colloidal size copper powder, for example, may permit even smaller proportions to be used than described herein. On the other hand, particle sizes greater than about 50 microns may require such a high copper proportion that it deleteriously affects the resultant hot formed article, requires subsequent processing for its removal, or the like.

My lubricant is primarily intended for use on ferrous powdered metal preforms containing more than 60% iron. It is useful on such preforms whether they are of prealloyed powder or not, and regardless of the particle size of powdered metal in the preform.

This invention was used on an annular preform of A. O. Smith 40F2 ferrous metal powder. This powder is described as passing through an 80 mesh screen and containing, by weight, 0.5% manganese, 0.55% molybdenum, and the balance iron, with 0.65% carbon added as dispersed graphite. The annular preform was made by compaction under a pressure of approximately 30 tons per square inch. The preform was warmed to a temperature of about 400° F. and dipped into the lubricant of this invention. There was no appreciable dwell, or soak time, of the preform in the lubricant. A uniform coating of my lubricant was produced on the preform.

The lubricant of this invention into which the preform was dipped had 12% by volume powdered copper having a particle size of 15 microns, and 88% by volume diluted commercial colloidal graphite lubricant. The diluted commercial colloidal graphite lubricant was made from a concentrated colloidal graphite commercial lubricant that contained 30% by weight solids in a liquid carrier that was predominantly water. The concentrated lubricant was diluted with 13 parts distilled water for mixture with the copper powder. The diluted lubricant containing the copper powder was agitated to maintain a uniform dispersion of solids.

The lubricant-coated preform was then induction heated within a quartz tube having an inert gas atmosphere. The inert gas was introduced at one end of the tube and exhausted at the opposite end of the tube. The tube had a small aperture in it in the induction heating area, to facilitate optical monitoring of preform temperature. The preform was heated to a temperature of about 2350° F., which required about 60 seconds. The temperature of the preform was measured with an optical pyrometer through the aperture in the quartz tube. No surface melting was observed and no change in emittance due to exothermic reactions was apparent. Induction heating was then discontinued. The preform was allowed to cool in the inert gas atmosphere until it reached a temperature of about 1400° –1800° F., as measured by the optical pyrometer. The preform was then removed from the quartz tube and immediately subjected to mechanical working in a hot forming press in the normal and accepted manner. A high density extremely high quality ring-shaped article was produced. No deleterious effects on the article were observed and the metal density exceeded 99%.

I claim:

1. In a colloidal graphite-containing, hot forming liquid lubricant for ferrous powdered metal articles, the improvement which comprises including in said lubricant about 2% to 4%, by weight, powdered copper, having a particle size less than about 50 microns, which improvement permits presintering of lubricant-coated ferrous powdered metal preforms at temperatures above about 2050° F.

2. A lubricant that permits presintering of lubricant coated ferrous powdered metal preforms above a temperature of 2050° F. without an adverse lubricant-preform interaction, said lubricant being a suspension of colloidal graphite in a liquid carrier, with said suspension containing about 2% – 4%, by weight powdered copper, said powdered copper having an average particle size no greater than about 15 microns, and the ratio by weight of powdered copper to graphite being at least about 0.7 to 1.

3. A concentrated colloidal graphite-type hot forming lubricant for ferrous powdered metal preforms, that permits heating of graphite lubricant-coated preforms above a temperature of about 2050° F., said concentrated lubricant comprising a liquid carrier, about 10% – 30%, by weight, colloidal graphite, and at least about 8%, by weight, powdered copper for dilution to a powdered copper concentration of about 2% – 4%, by weight, said powdered copper having an average particle size less than about 50 microns, and the ratio, by weight, of powdered copper to colloidal graphite, respectively, being greater than about 0.7 to 1 and less than about 13 to 1.

* * * * *

UNITED STATES PATENT AND TRADEMARK OFFICE

CERTIFICATE OF CORRECTION

PATENT NO. : 4,013,570

DATED : March 22, 1977

INVENTOR(S) : Harold G. Lemmer

It is certified that error appears in the above-identified patent and that said Letters Patent are hereby corrected as shown below:

Column 1, line 33, "involves heating" should read -- involves furnace heating --.

Column 2, line 54, "about 200° F." should read -- about 2000° F. --.

Signed and Sealed this

Seventh Day of June 1977

[SEAL]

*Attest:*

RUTH C. MASON
*Attesting Officer*

C. MARSHALL DANN
*Commissioner of Patents and Trademarks*